US008950643B2

(12) United States Patent
Shen

(10) Patent No.: US 8,950,643 B2
(45) Date of Patent: Feb. 10, 2015

(54) COMBINATION BACKPACK AND OVER-THE-SHOULDER BAG

(76) Inventor: Stanley Shen, Monrovia, CA (US)

( * ) Notice: Subject to any disclaimer, the term of this patent is extended or adjusted under 35 U.S.C. 154(b) by 240 days.

(21) Appl. No.: 13/463,783

(22) Filed: May 3, 2012

(65) Prior Publication Data

US 2013/0292441 A1 Nov. 7, 2013

(51) Int. Cl.
*A45F 3/02* (2006.01)
*A45F 3/04* (2006.01)

(52) U.S. Cl.
USPC ..... 224/578; 224/617

(58) Field of Classification Search
CPC ..... A45F 3/02; A45F 3/04
USPC ..... 224/578, 579, 580, 600, 627; 150/108
See application file for complete search history.

(56) References Cited

U.S. PATENT DOCUMENTS

| | | | | |
|---|---|---|---|---|
| 4,194,602 | A * | 3/1980 | Allen | 224/578 |
| 5,415,332 | A * | 5/1995 | Kliot | 224/153 |
| 5,577,652 | A * | 11/1996 | Cooper | 224/578 |
| 6,220,493 | B1 * | 4/2001 | Iijima et al. | 224/578 |
| 6,286,461 | B1 * | 9/2001 | Martz | 119/497 |
| 6,550,651 | B1 | 4/2003 | Murdoch et al. | |
| 7,070,077 | B2 | 7/2006 | Egart et al. | |
| 7,160,028 | B1 * | 1/2007 | Linday | 383/4 |
| 7,316,340 | B2 | 1/2008 | Marik | |
| D624,312 | S | 9/2010 | Chu et al. | |
| 2004/0065708 | A1 * | 4/2004 | Amram | 224/579 |
| 2005/0161485 | A1 | 7/2005 | Egart et al. | |
| 2006/0032883 | A1 | 2/2006 | Moreno et al. | |
| 2007/0051762 | A1 * | 3/2007 | Porter | 224/259 |
| 2008/0035693 | A1 * | 2/2008 | Lee | 224/578 |
| 2008/0277434 | A1 * | 11/2008 | Sacks | 224/153 |
| 2010/0108731 | A1 | 5/2010 | Rowe et al. | |
| 2013/0008934 | A1 * | 1/2013 | Liu et al. | 224/627 |

FOREIGN PATENT DOCUMENTS

DE 102011116293 A1 * 4/2013 ..... A45C 13/30

OTHER PUBLICATIONS

Daily Mail Reporter, "Is the man-bag burdening us with back pain? Loaded with Laptops and gym kits it's a hefty weight", Mail Online—Feb. 22, 2011.
"Targus 15" radius Convertible Messenger/Backpack TSB07701US, http://www.targus.com/ (accessed Apr. 20, 2012).
Backpack Safety, The Nemours Foundation, http://kidshealth.org (accessed Apr. 20, 2012).
Hybrid Bak2PakTM, BBP—Ergonomic Backpack, http://bbpbags.com/ergonomics.html (accessed Apr. 20, 2012).

(Continued)

*Primary Examiner* — Justin Larson
*Assistant Examiner* — Phillip Schmidt
(74) *Attorney, Agent, or Firm* — Michael Stanley Tomsa; Katten Muchin Rosenman LLP

(57) ABSTRACT

The present invention relates to bags, including backpacks and messenger bags. Specifically, the present invention relates to methods and apparatus for converting a bag between backpack and over-the-shoulder configurations. A combination bag may comprise a bag body having a front panel, a back panel, a bottom panel, and an opening opposite the bottom and a strap, wherein the strap is fixedly attached to the bag body at a first connection point and slideably coupled to the bag body at a second connection point, thereby enabling a wearer to alternate between an over-the-shoulder and a backpack configuration without requiring that the wearer disconnect or reconnect the strap.

21 Claims, 16 Drawing Sheets

(56) References Cited

OTHER PUBLICATIONS

BumBakPak Reviewed (Verdict: Looks Odd, Feels Great), GIZMODO http://gizmodo.com/201424/bumbakpak-reviewed-verdict-looks-odd-feel (accessed Apr. 20, 2012).

How to quickly turn your messenger bag into a backpack, Petervonpanda http://www.youtube.com/watch?v=YuKNueSv_PU (accessed Apr. 20, 2012).

Cottalorda, Jérôme et al, "Influence of school bag carrying on gait kinetics" Journal of Pediatric Orthopaedics B: Nov. 2003—vol. 12—Issue 6—pp. 357-364 Abstract.

"Messenger Bag", http://en.wikipedia.org/wiki/Messenger_bag (accessed Apr. 20, 2012).

Tumi Alpha 3-in-1 Backpack/Messenger Bag, http://www.amazon.com/Tumi-Alpha-Backpack-Messenger-Bag/dp/B00 (accessed Apr. 20, 2012).

Mrs. Smith's bags: How to Convert Messenger to Backpack (Tempo and Basic), http://www.youtube.com/watch?v=J_wuU1Gqu0c (accessed Apr. 20, 2012).

Optimus Backpack—Quiksilver, http://www.quiksilver.com/product/index.jsp?productId=11195687 (accessed Apr. 20, 2012).

Lobster clasps hook by bagpurseframes on Etsy, http://www.etsy.com/shop/bagpurseframes?section_id=6937677 (accessed Apr. 20, 2012).

* cited by examiner

COMBINATION BACKPACK AND OVER-THE-SHOULDER BAG

FIELD OF THE INVENTION

The present invention relates to bags, including backpacks and messenger bags. Specifically, the present invention relates to systems, methods, apparatuses, and strap systems for converting a bag between backpack and over-the-shoulder configurations.

BACKGROUND OF THE INVENTION

Traditional, dual-strap backpacks typically comprise a large carrying bag and two shoulder straps that may be slung over the shoulders. Each shoulder strap may be attached near an upper and a lower corner of the bag such that the contour of each strap forms a rough loop between the strap and the bag through which the wearer inserts one of his arms. As is known in the art, the straps may be made from, for example, padded material and nylon webbing. The padded material increases comfort for the wearer's shoulders when bearing the weight of the backpack. When worn, the weight of the backpack is borne by the shoulders, and the backpack is carried on the wearer's back.

Over the years, studies have shown that using both shoulder straps to carry a bag is preferable to using just one (i.e., slinging the backpack over a single shoulder) because the weight load is evenly distributed across the body, thereby making it easier to carry heavy loads for longer periods. However, over the course of the last decade, single-strap, over-the-shoulder bags have grown significantly in popularity, effectively replacing the more traditional, dual-strap backpack for many adults and adolescents. These over-the-shoulder bags come in a variety of styles and formats, including, for example, over-the-shoulder satchels, messenger bags, shoulder briefcases, sling bags, "man-bags," purses, and the like. Interestingly, everyday, over-the-shoulder bags for men have become increasingly popular in recent years as trendsetters such as footballers David Beckham and Rio Ferdinand, and actor Brad Pitt are often spotted sporting them. Their popularity may also be driven by electronic advancements. For example, some fashion experts predict that the popularity of the tablet computers, such as the Apple® iPad, may prompt a further fad as men search for something to carry them in. For additional information, see, for example, *Is the man-bag burdening us with back pain? Loaded with laptops and gym kits it's a hefty weight*, Daily Mail Reporter, Feb. 22, 2011, available at http://www.dailymail.co.uk/femail/article-1359349/Is-man-bag-burdening-pain.html.

As suggested by the title of the Daily Mail Reporter article, despite being considered stylish and fashionable, single-strap over-the-shoulder bags can lead to back pain that typically results from the weight of the bag not being balanced, thereby forcing the wearer to compensate by leaning to one side or flexing the spine. For example, as noted by the Daily Mail Reporter article's Tim Hutchful, a British Chiropractic Association spokesman, "Man-bags could cause back and shoulder pain from prolonged stress, this could also impact posture." Thus, compared with single-strap, over-the-shoulder bags, dual-strap backpacks are better for the body because the strongest muscles in the body—the back and the abdominal muscles—evenly support the weight of the bag. In fact, doctors typically advise patients to carry their bags on two shoulders rather than use a single-strap, over-the-shoulder bag or just a single backpack strap.

To accommodate design trends while providing the wearer with the ability to reduce back pain by supporting a bag with two straps, a need exists for an easy-to-use combination bag that can be converted from a single-strap, over-the-shoulder bag to a dual-strap backpack. A handful of products on the market enable a wearer to make such a conversion, but they make the wearer add or remove straps, thereby complicating and unnecessarily slowing the transition.

For example, the Alpha 3-in-1 Backpack/Messenger Bag by Tumi® provides a system of handles and straps that allows the wearer to carry the bag in a variety of ways. Although the Tumi® bag provides the wearer with the option of either a single-strap or dual-strap configuration, the wearer must disconnect/reconnect the system of straps to make the conversion. Thus, the wearer cannot easily and efficiently switch between the over-the-shoulder and backpack configurations because the Tumi® bag requires additional straps or components. For additional information, see Tumi's® website at http://www.tumi.com or Amazon's product page at http://www.amazon.com/Tumi-Alpha-Backpack-Messenger-Bag/dp/B001XCXBWS.

Similarly, BBP Industries offers a system for carrying an over-the-shoulder messenger in a backpack configuration. The BBP system, known as the Bak2 Pak system, is very similar to Tumi's® Alpha 3-in-1 and also requires the wearer to disconnect/reconnect the system of straps to make the conversion. Thus, the wearer cannot easily and efficiently switch between the over-the-shoulder and backpack configurations because the Bak2 Pak system, like the Tumi® system, requires additional straps or components. For additional information, see BBP's website at http://bbpbags.com/ergonomics.html#Assembly:32Tips.

Therefore, despite previous attempts, a need exists for a system, method, apparatus, and/or strap system for efficiently switching a bag between over-the-shoulder and backpack configurations without requiring additional straps or components. A need also exists for a system, method, apparatus, and/or strap system for efficiently switching a bag between over-the-shoulder and backpack configurations without making the wearer disconnect/reconnect the straps or buckles.

SUMMARY OF THE INVENTION

The present invention addresses the need for efficiently switching a bag between single-strap, over-the-shoulder and dual-strap backpack configurations without requiring additional straps or components and/or without requiring the wearer disconnect/reconnect the straps or buckles.

According to a first aspect of the present invention, a combination bag comprises: a bag body having a front panel, a back panel, a bottom panel, and an opening opposite the bottom panel; a plurality of connection points positioned along the bag body, each connection point having a securing mechanism; and a strap, wherein the strap is fixedly attached to the bag body at a first connection point and slideably coupled to the bag body at a second connection point, whereby the strap is configured to enable a wearer to alternate between an over-the-shoulder and a backpack configuration without disconnecting or reconnecting the strap.

According to a second aspect of the present invention, a combination bag comprises a bag body having a front panel, a back panel, a bottom panel, and an opening opposite the bottom panel; a plurality of connection points positioned along a periphery of the bag body, each connection point having a securing mechanism; and a strap, wherein the strap comprises at least one connector for attaching an end of the strap to the bag body, wherein the strap is fixedly attached to a first securing mechanism using said at least one connector and slideably coupled with a second securing mechanism, whereby the strap is configured to enable a wearer to alternate between an over-the-shoulder and a backpack configuration without disconnecting or reconnecting the strap.

According to a third aspect of the present invention, a combination bag comprises: a bag body having a front panel, a back panel, a bottom panel, a first side panel, a second side panel opposite the first side panel, and an opening opposite the bottom panel; four hoops, wherein two hoops are positioned on the first side panel and two hoops are positioned on the second side panel; and a strap having a first end, a second end and a strap portion therebetween, wherein a connector is positioned at each of said first and second ends and configured to couple with at least one of said hoops; wherein said strap portion passes through at least one of said hoops; wherein the strap is configured to enable a wearer to alternate between an over-the-shoulder and a backpack configuration without disconnecting or reconnecting the strap.

In certain aspects, the contour of the strap forms a single rough loop while in the over-the-shoulder configuration. Similarly, the contour of the strap forms two rough loops while in the backpack configuration.

In certain aspects, the strap may be fixedly attached to the bag body at the first connection point by connecting a connector positioned at an end of the strap to a first securing mechanism positioned on the bag body, and slideably coupled with the bag body at the second connection point by passing a portion of the strap through a second securing mechanism positioned on the bag body.

In certain aspects, the securing mechanism may be a ring, a hoop, carabiner, or a loop.

In certain aspects, the strap is adjustable in length and/or comprises one or more slideably attached padded portions.

In certain aspects, the bag body and the strap may be constructed from a material chosen from the group consisting of leather, polymers, fabric, chains, cables, rope, or combinations thereof.

DESCRIPTION OF THE DRAWINGS

Embodiments of the present invention are illustrated by way of example, and not by limitation, in the figures of the accompanying drawings, in which like references indicate similar elements and in which.

DETAILED DESCRIPTION

The present invention is described herein with reference to one or more exemplary embodiments; however, it should be understood that the present invention is not limited to these embodiments. Those skilled in the art will appreciate that other arrangements, formulations, and elements can be used instead and that some elements may be omitted altogether. In the following description, well-known functions or constructions may not be described extensively because they would obscure the invention in unnecessary detail.

A combination bag, as disclosed herein, generally comprises a compartment that may be sealed off using buckles, straps, zippers, hook-and-loop fasteners (e.g., VELCRO®), or otherwise, and a shoulder strap that may be configured to attach to one or both shoulders. As will be described, the shoulder strap may be padded at one or more points to increase comfort, typically at points that make contact with the wearer. Moreover, the shoulder strap may be adjustable in length to adjust to the size of the specific wearer.

Figure 1:
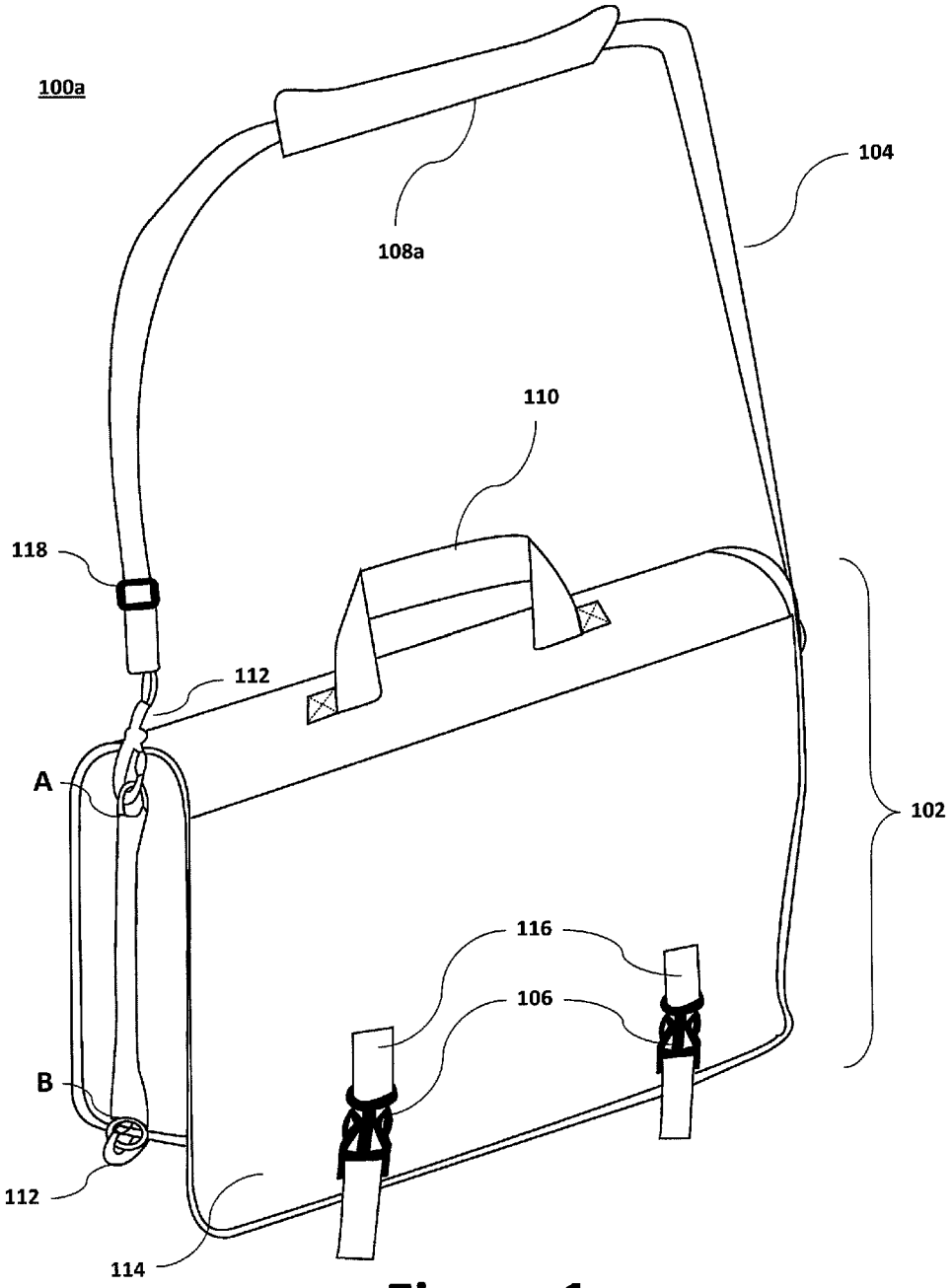
FIG. 1 is a front perspective view of an example combination bag according to a first aspect in an over-the-shoulder configuration.

FIG. 1 illustrates a front perspective view of a combination bag 100*a* according to a first aspect of the present invention. FIG. 1 illustrates the combination bag 100*a* in an over-the-shoulder configuration. As illustrated, the combination bag 100*a* generally comprises a bag body 102 and a strap 104.

The bag body 102 may be constructed from two or more panels that define an interior cavity, or major storage compartment, having an opening. For example, a bag body 102 may include a back panel configured to lie adjacent to the body of a wearer, a front panel configured opposite the back panel, a bottom panel opposite an opening, and a pair of opposed sides substantially nonparallel to the back panel. However, it is contemplated that a suitable bag body 102 may also be constructed using fewer panels. For example, the bag body 102 may be constructed from only a back panel configured to lie adjacent to the body of a wearer and a front panel configured opposite the back panel. To form an interior cavity, the two panels may be sewn or otherwise joined along, for instance, three sides, with the opening positioned at the fourth side. Alternatively, one large panel may be folded to form a pocket where the folded panel may be sewn along two sides. Conversely, additional panels, such as 5 or more, may be introduced to make a wide array of bag shapes and styles. Thus, a combination bag 100*a* should not be limited only to the type of bag body 102 illustrated throughout the figures.

The bag body's 102 opening provides the wearer with access to the compartment from the exterior of the bag body 102. To reduce the risk of theft and/or loss of personal property, the opening may be sealed or closed using known methods. For example, the satchel type bag body 102 of FIG. 1 provides a flap 114 that may fold over the opening, thus substantially sealing the opening when closed. The flap 114 may be locked in the closed position using, for example, a buckle 106 or other similar means, such as hook-and-loop fastening material (i.e., VELCRO®), snaps, magnets, or the like. In certain aspects, the flap 114 may be locked in the closed position using knots and hitches.

In addition to, or in lieu of, the flap 114, a releasable fastener/closure may extend along the opening such that when the releasable closure is opened, access may be thereby provided to the major storage compartment. Thus, the flap 114 may be entirely omitted in favor of a releasable closure. The releasable closure may take any of a variety of forms, including a zipper, a slide fastener, hook-and-loop fastening material (i.e., VELCRO®), snaps, magnets, or the like.

A buckle 106 with a means for adjusting the securing strap 116 length may be used so that a wearer can adjust the tension of the flap 114 when closed, thereby accommodating, for example, larger items to be stowed. A quick-release buckle, while not essential, may function as the buckle 106 and secure the flap 114 when closed. Quick-release buckles are commonly used in camping equipment and are well known in the art. A benefit of the quick-release buckle is that it enables a wearer to quickly and easily separate and reattach flap 114 end from/to the bag body 102. While a quick-release buckle is shown, other mechanisms are contemplated; thus, the buckle 106 should not be limited to quick-release buckles. For example, snaps, clips, magnets (e.g., a magnetic buckle or magnetic snaps), cam buckles, traditional buckles, adjustable hinged buckles, or any other latching/buckling mechanism known in the art of backpack/bag/purse design may serve the general function of buckle 106. In some aspects, the combination bag 100*a* may further include features for bicycling such as lights, phone holsters, or U-locks.

The strap 104 may be constructed from either a single length of material or multiple lengths joined end to end. The distal ends of the strap 104 may be equipped with a connector 112 for coupling the distal ends with the bag body 102. The connector 112 may be, for example, a swivel clasp, a push-gate snap hook, a quick-release buckle, a lobster claw swivel hook, carbine hook, carabiner, or any other clasping device known in the art of backpack/bag/purse design. Alternatively, rather than using a connector 112, the distal ends of the strap may be configured to be tied to form, for example, knots and hitches. As will be discussed in greater detail below, the bag body 102 may be provided with one or more securing mechanisms, such as hoops or loops, to facilitate connection of the connector 112 at one or more connection points A, B, C, D.

The strap 104 may be adjusted lengthwise to facilitate the size and needs of various wearers and/or applications. For example, the strap 104 may comprise two connected segments of material, whether separate or portions of a single length, connected so that the wearer can adjust the tightness of the shoulder strap but not easily separate the segments. The strap segments may be connected using, for example, a strap 104 length adjustment mechanism 118. The strap 104 length adjustment mechanism 118 may comprise, for example, one or more strap adjustors, slides, center bar buckles, adjustable hinged buckles, clasp buckles, slide release buckles, and so on. In certain aspects, a strap 104 length adjustment mechanism may be integrated, or coupled, with the connector 112, thereby permitting the wearer to adjust the length of the strap 104 at the strap's distal ends.

As illustrated, a carrying handle 110 may be positioned on the top of the bag body 102 between the strap 104 connection points A, C to provide a means by which the combination bag 100*a* can be carried by hand.

The bag body 102, strap 104, and handle 110 can all be made of a wide variety of flexible, durable sheet-like materials, such as leather, fabric (e.g., canvas), polymers (e.g., polyester, nylon, ballistic nylon, Cordura 1000 Super Durable Water Resistant Nylon by Invista, etc.), fabric, or combinations thereof. The materials may be woven, stamped, molded, or in various other forms. While a designer may wish to construct the bag body 102, strap 104, and handle 110 from the same material (e.g., for aesthetics or uniformity), it is by no means required. Rather, each component may be made from a different material. In fact, even the panels that make up the bag body 102 need not be of the same type of material. For instance, it may be advantageous to construct certain panels from a stronger material to prevent ripping and/or tearing at stress points, such as the connection points A, B, C, D. In certain aspects, the strap 104 may be constructed using chains, cables, rope or combinations thereof.

The bag body's 102 inner cavity may further contain a lining. For example, suede, cotton, silk, canvas, tarp, and/or tarp shielding may be used to provide an inner lining. Other materials may include vinyl waterproof tarp lining, which may be used to make the bag waterproof. When a softer outer material is used, the liner may provide a support structure for the bag, thus keeping the bag from falling over on itself.

A nonessential addition to the strap 104 may be a waist strap, which may be attached to the bag body 102 at two or more connection points (e.g., connection points C, D). The waist strap may help secure the bag body 102 to the wearer's body during use. Like the other strap 104, the waist strap is preferably adjustable in length. A quick-release buckle or cam buckle may be preferred to separably attach the waist strap to the bag body 102 and/or around the wearer because either can quickly be coupled/decoupled, but other connectors may be used. When not in use, the waist strap may be buckled at the two or more connection points and adjusted in length (e.g., shortened) to be kept out of the way. However, the waist strap is not essential to the present disclosure.

Figure 2:
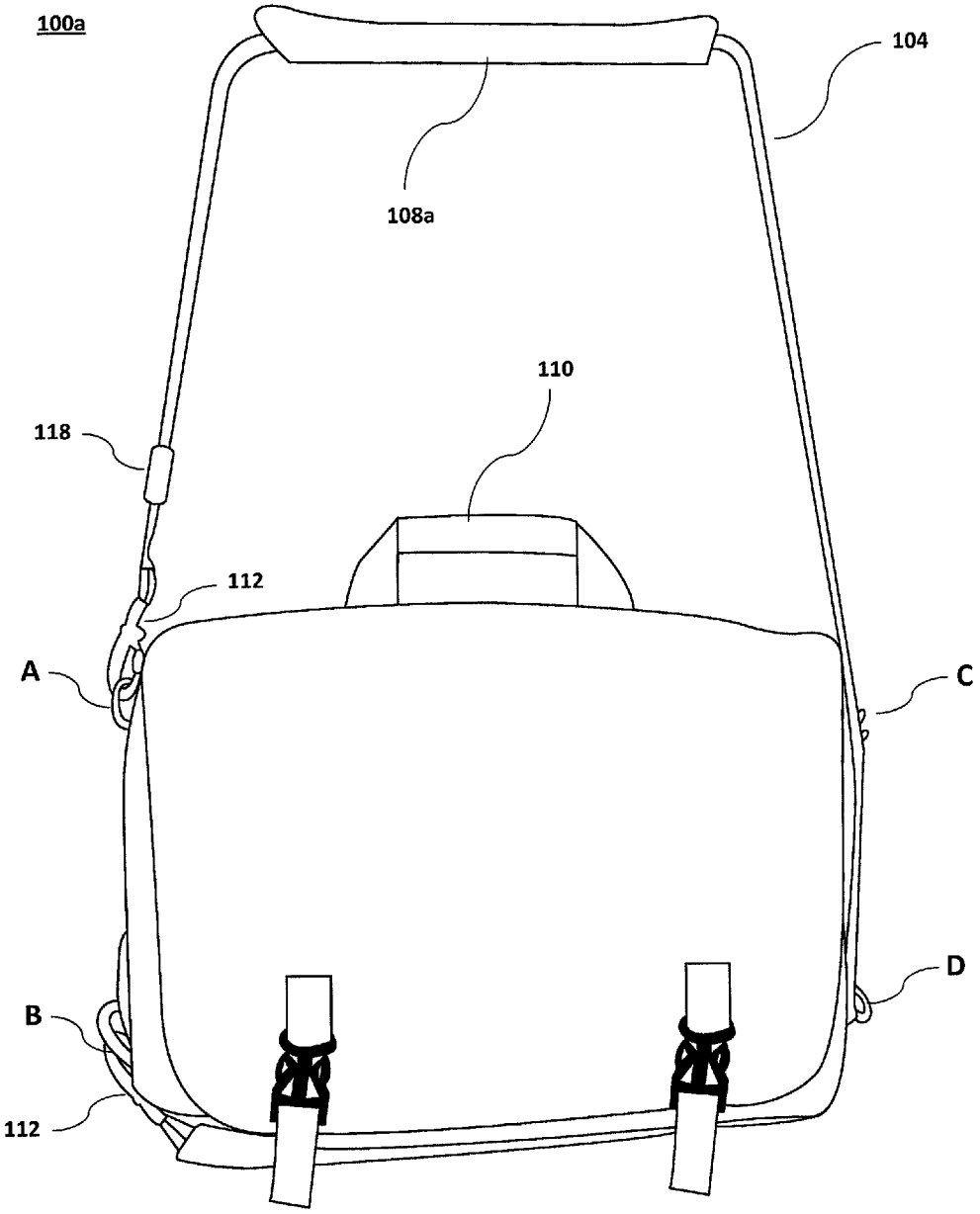
FIG. 2 is a front view of the combination bag of FIG. 1 in the over-the-shoulder configuration.
Figure 3:
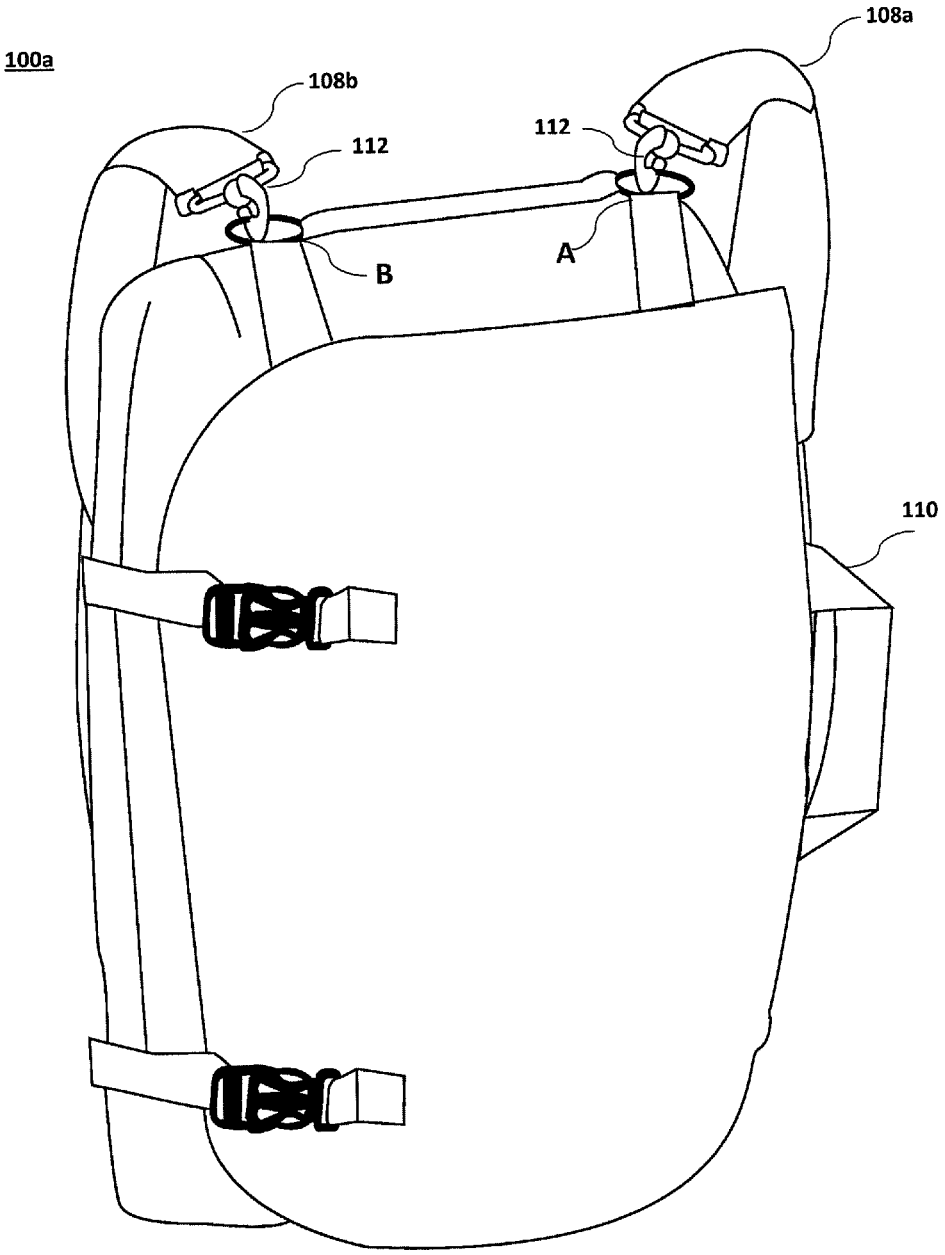
FIG. 3 is a top angle view of a combination bag of FIG. 1 in a backpack configuration.

As disclosed throughout the figures, but with particular attention to FIG. 2, the strap 104 may be attached to the bag body 102 at four connection points A, B, C, D positioned along the periphery of the bag body 102. As taught herein, the periphery may be generally defined by the perimeter of the front and/or back panels. Thus, as illustrated, the connection points A, B, C, D may be positioned on the side panels along the bag body's 102 periphery. Though four connection points A, B, C, D are illustrated, one of skill in the art would appreciate that additional connection points may be included to facilitate a particular application, such as a larger or uniquely shaped bag. Similarly, fewer connection points (e.g., two) may be used for smaller bags, such as sling bags, purses, and so on.

As illustrated, the strap 104 may be connected such that the strap 104 lies substantially along the periphery of the bag body (e.g., substantially adjacent to one or more of the bag body's 102 sides). For example, when the combination bag 100*a* is in the over-the-shoulder configuration, the strap 104 may lie adjacent to three of the four sides with the arm loop being positioned on the fourth side. Similarly, when the combination bag 100*a* is in the backpack configuration (e.g., FIGS. 3-4*b*, and 11), the strap 104 may lie adjacent to two of the four sides, with the arm loops being positioned on the remaining two sides (e.g., between connection points A, B and C, D or between connection points A, C and B, D).

Although the connection points A, B, C, D are illustrated as being positioned on only two sides of the bag body 102 (i.e., the side panels), the connection points A, B, C, D may be repositioned as desired by the designer. For example, the connection points A, B, C, D may be positioned on the top (e.g., on the top of the flap 114), bottom, sides, back panel, front panel, corners (e.g., where two or more panels meet), or a combination thereof.

To facilitated strap attachment, each connection point A, B, C, D preferably comprises a securing mechanism. For example, as illustrated in the figures, a hoop or other loop-like device may be used as the securing mechanism. In certain aspects, it may be advantageous to provide a removable securing mechanisms. For example, a carabiner may be used to function as the securing mechanism. The hoop, which need not be circular, may be constructed from a variety of materials including, for example metal, metal alloys, wood, bone, and/or synthetic materials, such as plastic. The hoop may be affixed to the bag body 102 using known techniques. For example, a piece of material may be folded to form a loop around a portion of the hoop and attached to the bag body using stitching, fusing, and/or riveting techniques. Alternatively, as illustrated in FIG. 4*b*, the hoop may pierce the outer layer (or layers) of the bag body 102. In this alternative, the material around the piercing may be reinforced or constructed from a heavy duty material (e.g., para-aramid synthetic fiber, such as Kevlar®). To reduce wear and tear on the bag's material, the piercing holes may be reinforced using hardware (e.g., a grommet or eyelet) or by folding and joining (e.g., stitching or fusing) the material at the edge of the hole to increase the thickness and durability of the material.

Although a rigid substantially circular hoop is depicted, the securing mechanism may also be formed from a soft or flexible material. For example, the securing mechanism may be constructed from a piece of securing material, such as nylon webbing or a material like that used to fabricate the bag body 102, folded over to form a loop of sufficient size to enable the strap 104 to pass therethrough. Again, the ends of the securing material may then be attached to the bag body 102 using known techniques, such as stitching, fusing, rivets, and so on.

In certain aspects, one or more slits may be cut into the bag body's 102 panels at one or more connection points A, B, C, D to provide a more streamlined look by eliminating the need for rings or loops. For example, the bag body's 102 outermost layer (or layers) may be provided with egress and ingress slits for the strap 104 to pass therethrough. Using FIG. 2 as a reference, one slit may be provided at connection point C, and a second slit may be provided at connection point D. In operation, the strap 104 ingresses via the slit at connection point C and travels under the outermost layer (or layers) of the bag and egresses at connection point D. To reduce wear and tear on the bag's material, the slits may be reinforced using hardware (e.g., a grommet or eyelet) or by folding and joining (e.g., stitching or fusing) the material at the edge of the slit to increase the thickness and durability of the material.

To facilitate a quick and easy transition between over-the-shoulder and backpack configurations, the strap 104 should not be fixedly attached at every connection point A, B, C, D, because it would force the wearer to disconnect and/or reconnect the straps to make the conversion. An example of fixedly attaching the strap 104 would include, for example, coupling a connector 112, which may be positioned a distal end of the strap 104, to one or more hoops or loops positioned at a connection point A, B, C, D on the bag body 102. Another example of fixedly attaching the strap 104 would include tying the strap 104 to the bag body using knotting techniques. For instance, when a cable or rope is used as the strap 104, or portion thereof, the end of the strap 104 may be tied around one or more hoops or loops to form a knot or secured using a rope/cable clip.

Rather, the strap 104 should be slideably coupled to the bag body 102 at one or more connection points. For example, the combination bag 100*a* should be configured such that the strap 104 may pass through the opening of a hoop or loop (i.e., the inner space defined by a hoop or loop) at one or more connection points A, B, C, D. Thus, the strap would be secured adjacent to the bag body 102's surface, but able to travel along, or parallel to, the bag body 102's surface.

Moreover, while the strap 102 may be connected at its distal ends to form a loop and slideably coupled at every connection point A, B, C, D to prevent the strap 104 at a particular point from rotating or slipping over time, the strap 104 may be fixedly attached at one or more connection points (e.g., connection points A, B) using a connector 112 as illustrated in FIGS. 1 through 11. According to this aspect, the strap 104 may be fixedly attached to the bag body 102 at only connection points A and B, while the remaining connection points C and D are slideably coupled using, for example, a hoop, a loop, or a slit.

To increase comfort for the wearer, the strap 104 may include one or more padded portions 108*a*, 108*b*. The padded portions 108*a*, 108*b* are preferably slideably attached to the strap 104 in order to accommodate the wearer whether in over-the-shoulder or backpack configuration. Providing slideably attached padded portions 108*a*, 108*b* also permits the wearer to alternate shoulders when in the over-the-shoulder configuration while ensuring alignment of the padded portions 108*a*, 108*b* (e.g., ensuring it is positioned on the shoulder(s) of the wearer).

Figure 4A:
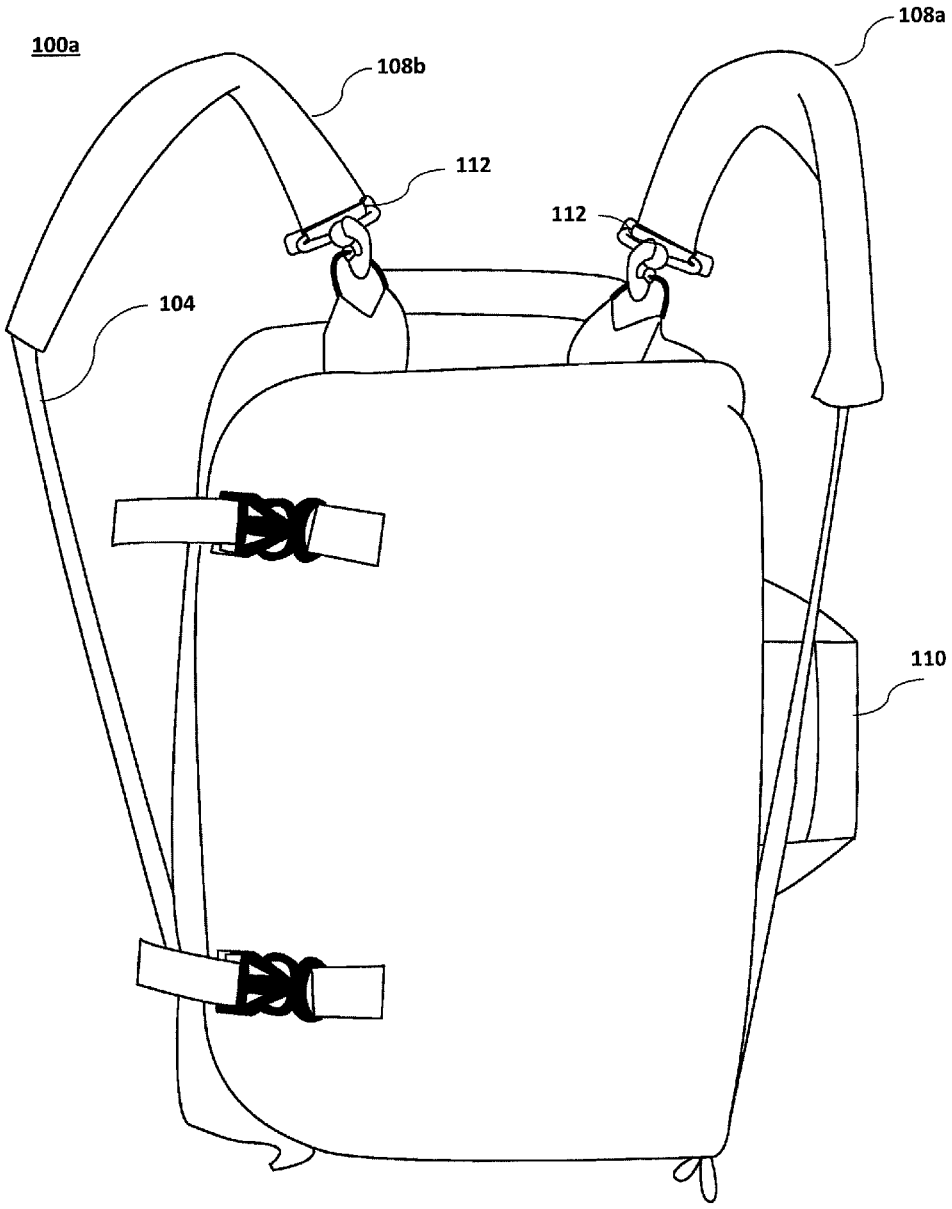
FIG. 4*a* is a front view of a combination bag of FIG. 1 in the backpack configuration.
Figure 4B:
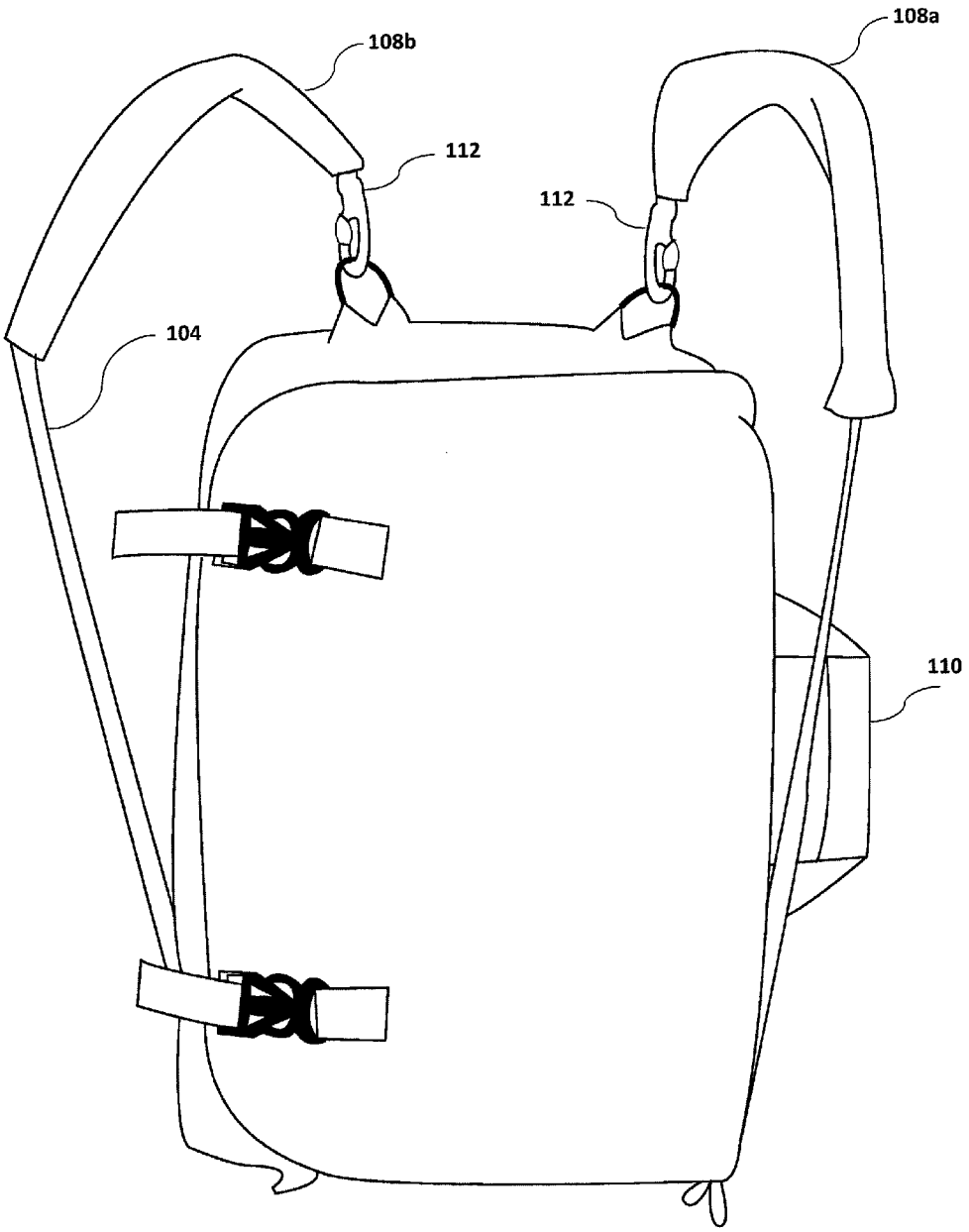
FIG. 4*b* is a front view of a combination bag in a backpack configuration according to another aspect.
Figure 5:
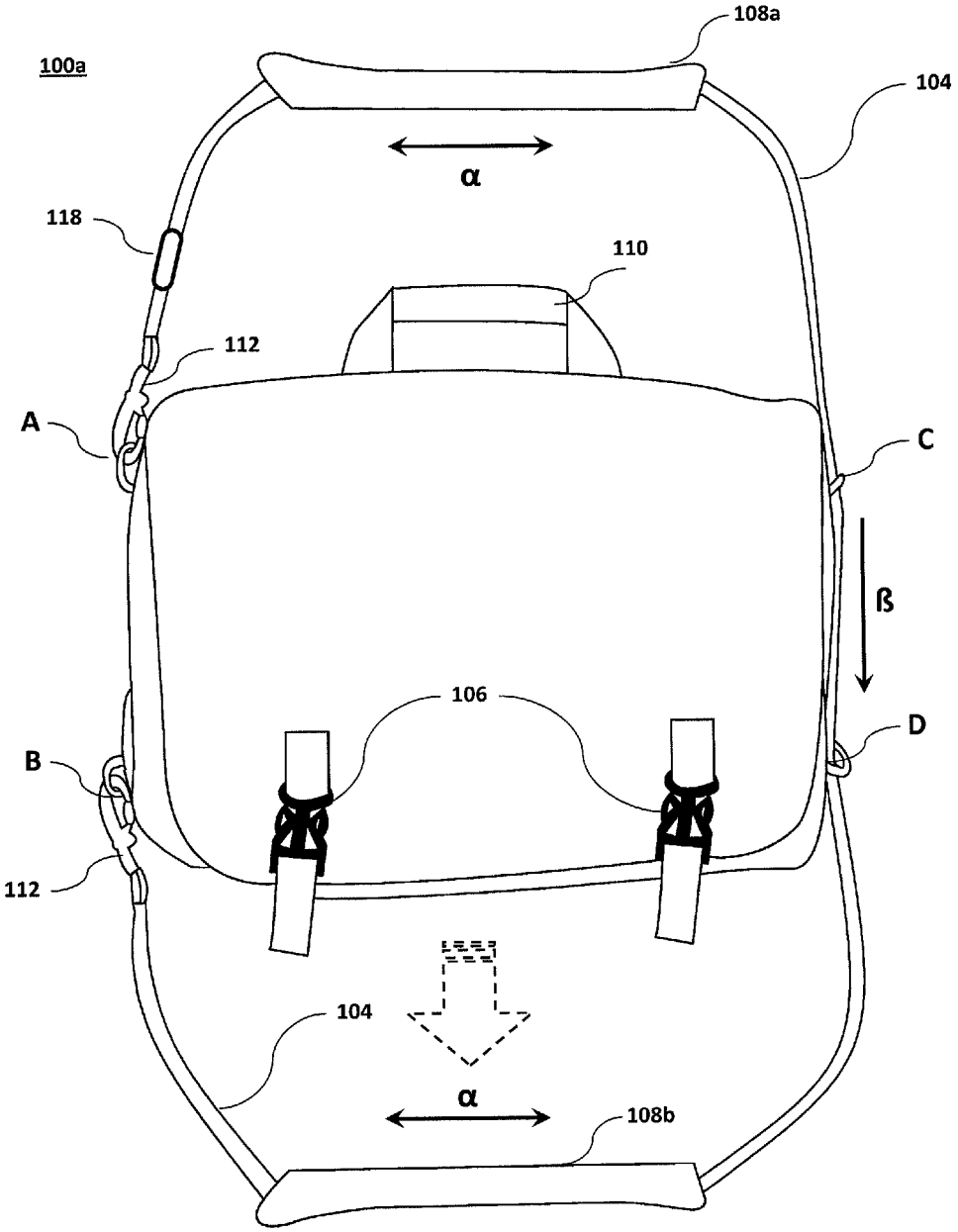
FIG. 5 is a front view of the combination bag of FIG. 1 during transition from the over-the-shoulder configuration to the backpack configuration.

As illustrated in FIG. 5, to transition from the over-the-shoulder configuration of FIG. 2 to the backpack configuration of FIG. 4, the wearer need only tug the strap portion between connection points B & D (e.g., via a padded portion 108*b*), which may be positioned opposite the handle 110, thereby causing the strap 104 to travel through connection points C, D in direction B. As the wearer pulls the strap portion positioned opposite the handle 110, the strap portions on each side of the bag body 102 (i.e., between connection points A & C and connection points B & D) form a rough loop between the contour of the strap 104 and the bag body 102, through which the wearer may insert one of his arms. The wearer may pull the strap until the strap portions on each side of the bag body 102 are approximately equal, thereby forming two shoulder straps. The two shoulder straps may be slung over the shoulders so that the weight of the backpack is distributed on the shoulders and the combination bag 100*a* can be carried on the back in a manner akin to that of a traditional, dual-strap backpack. As previously noted, the padded portions 108*a*, 108*b* may be slideably attached to the strap 104 so that they may be adjusted in direction $\alpha$.3

The process for transitioning from the backpack configuration of FIG. 4 to the over-the-shoulder configuration of FIG. 2 is substantially the same, but performed in reverse. For example, the wearer need only tug the strap portion between connection points A & C (e.g., via a padded portion 108*a*), which may be positioned near the handle 110, thereby causing the strap 104 to travel through connection points C, D in a direction opposite of direction B. As the wearer pulls the strap portion between connection points A & C, the strap portion on the bottom side of the bag body 102 (i.e., between connection points B & D) begins to shorten, thus eliminating the rough loop while the strap portion on the top side of the bag body 102 (i.e., between connection points A & C) forms a larger rough loop between the contour of the strap 104 and the bag body 102 through which the wearer may insert one of his arms. The single shoulder strap may be slung over the shoulder in a manner akin to that of a traditional, single-strap, over-the-shoulder bag.

Figure 6:
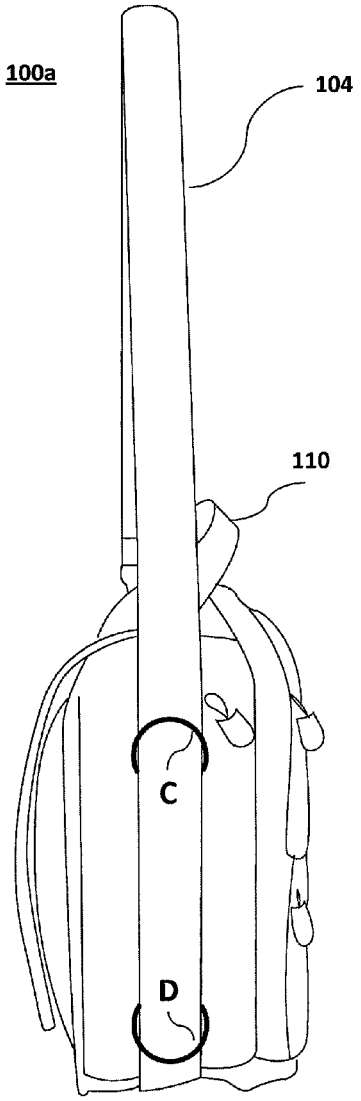
FIG. 6 is a first side view of a combination bag of FIG. 1 in the over-the-shoulder configuration.
Figure 7:
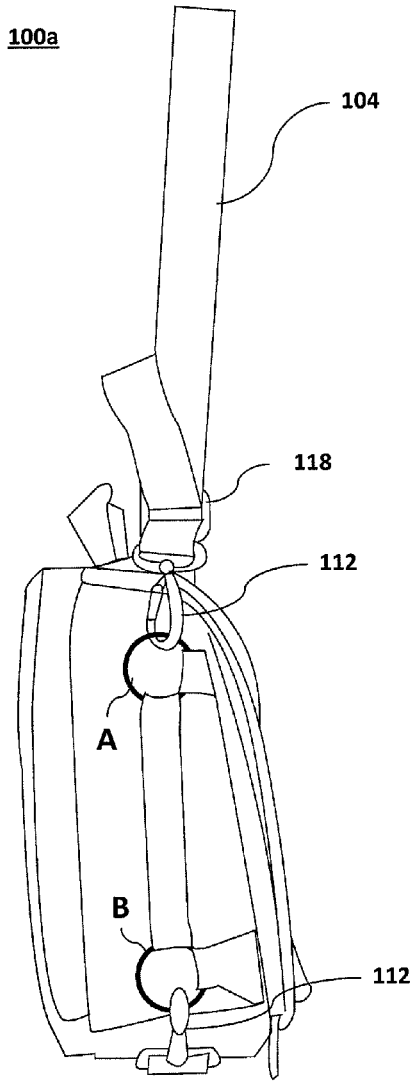
FIG. 7 is a second side view of a combination bag of FIG. 1 in the over-the-shoulder configuration.

FIGS. 6 and 7 provide side views of the combination bag 100*a* of FIG. 1. As illustrated, the strap 104 may be fixedly attached to the bag body 102 at connection points A, B and slideably coupled to the bag body 102 at connection points C, D.

Figure 8:
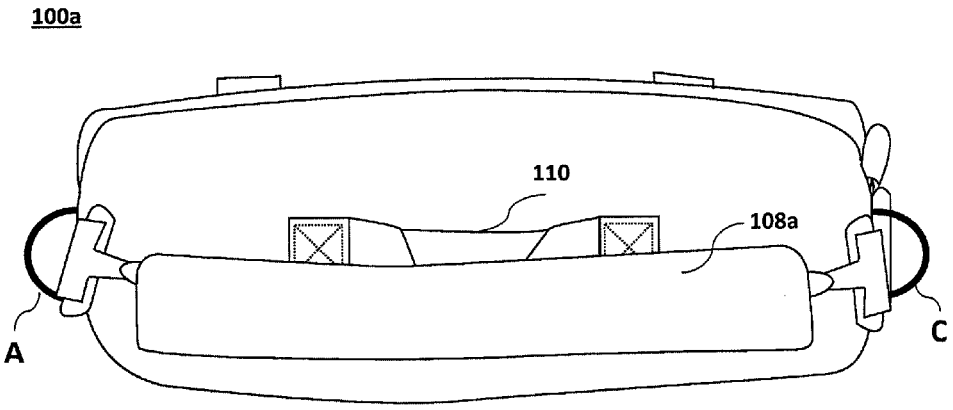
FIG. 8 is a top view of a combination bag of FIG. 1 in the over-the-shoulder configuration.
Figure 9:
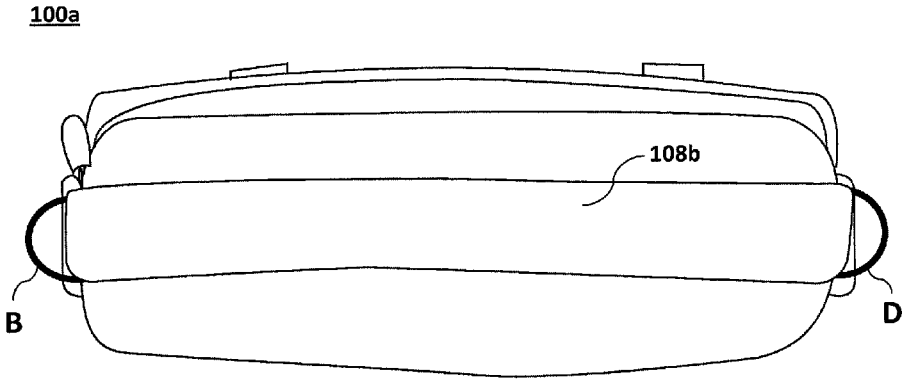
FIG. 9 is a bottom view of a combination bag of FIG. 1 in the over-the-shoulder configuration.

FIG. 8 illustrates a top view of the combination bag 100*a* in the over-the-shoulder configuration. For simplicity, excess strap 104 has been omitted from the figure to avoid obscuring the bag body 102. FIG. 9 illustrates a bottom view of the combination bag 100*a* in the over-the-shoulder configuration.

Figure 10:
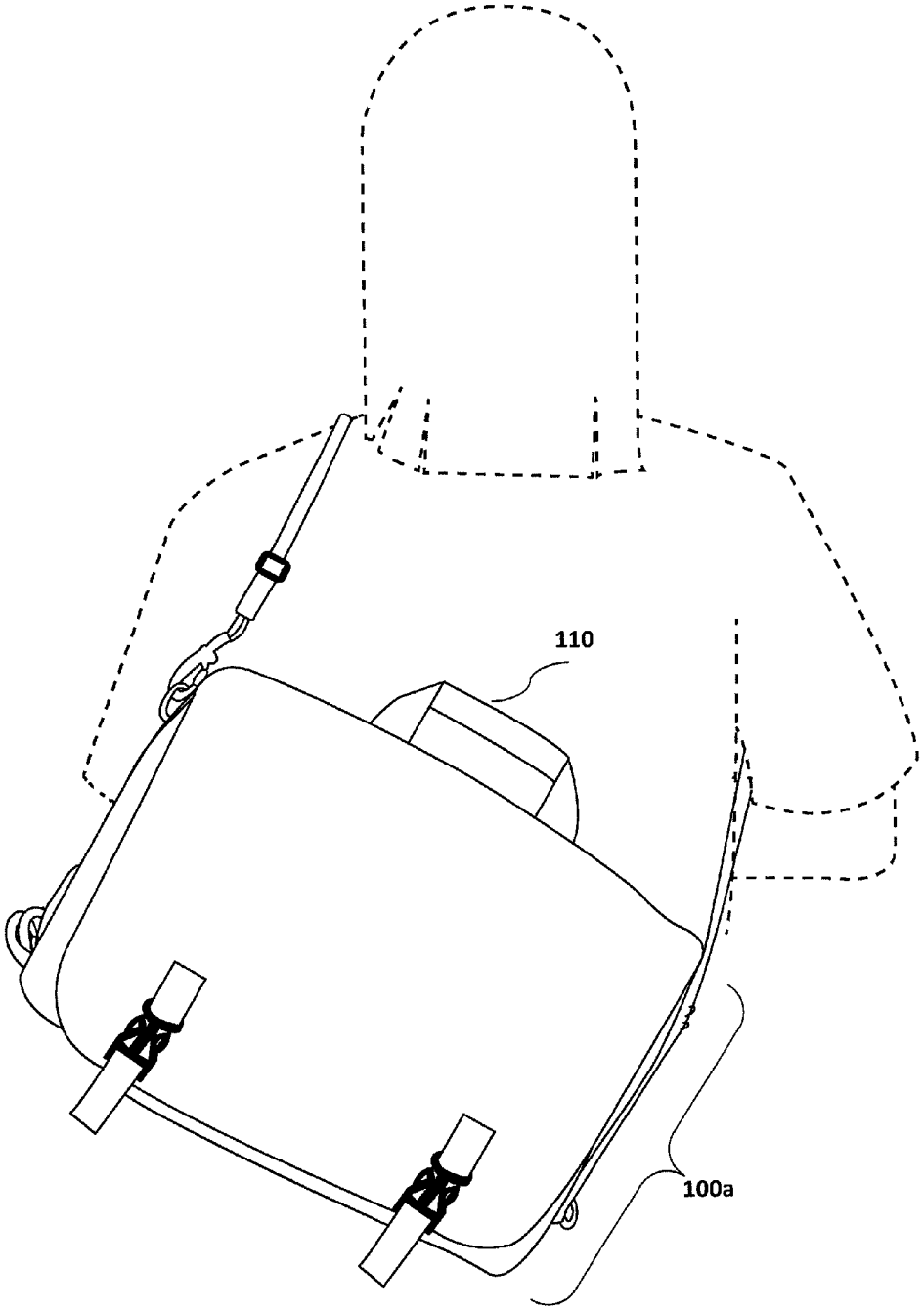
FIG. 10 is a view of a combination bag of FIG. 1 in the over-the-shoulder configuration while being used by a wearer.
Figure 11:
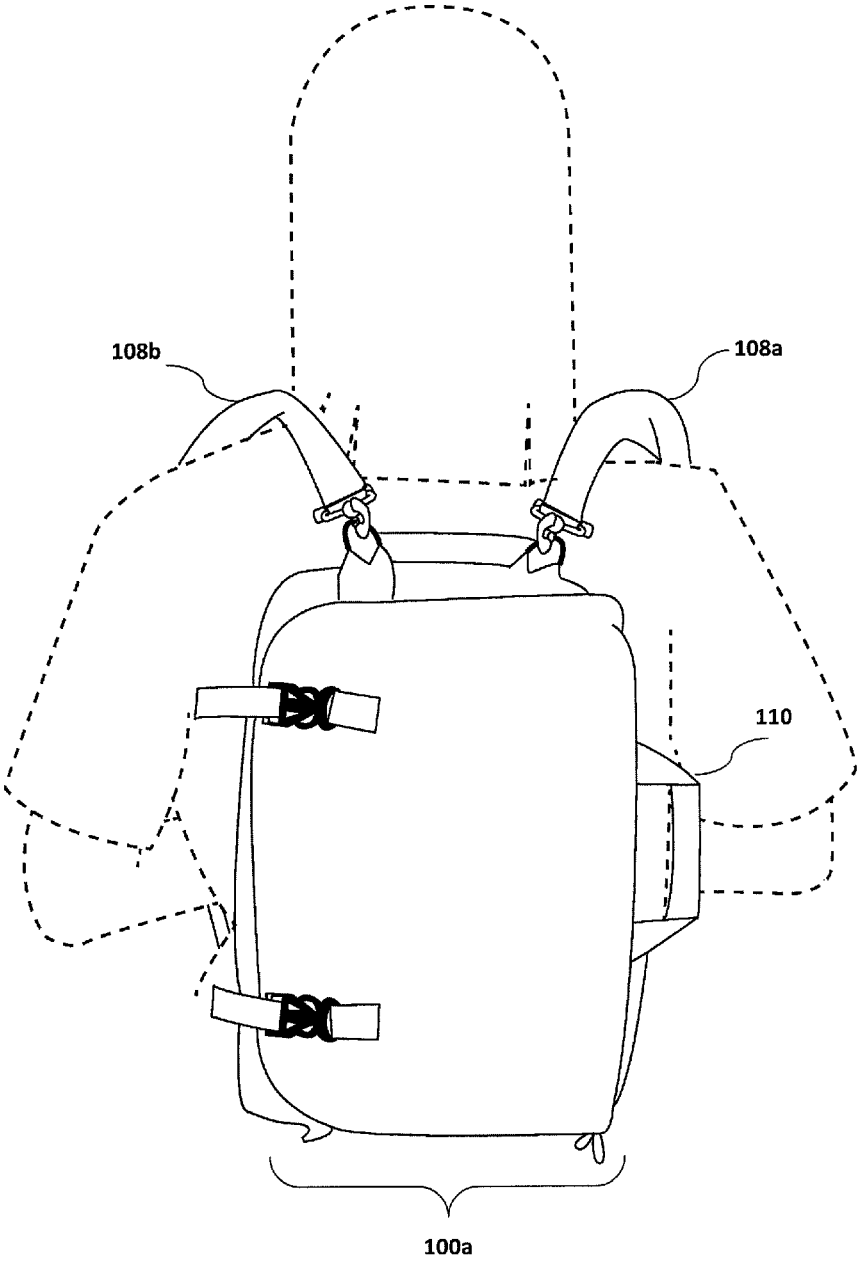
FIG. 11 is a view of a combination bag of FIG. 1 in the backpack configuration while being used by a wearer.

FIG. 10 provides a view of the combination bag 100*a* in the over-the-shoulder configuration while in use by a wearer, and FIG. 11 provides a view of the combination bag 100*a* in a backpack configuration while in use by a wearer.

Figure 12:
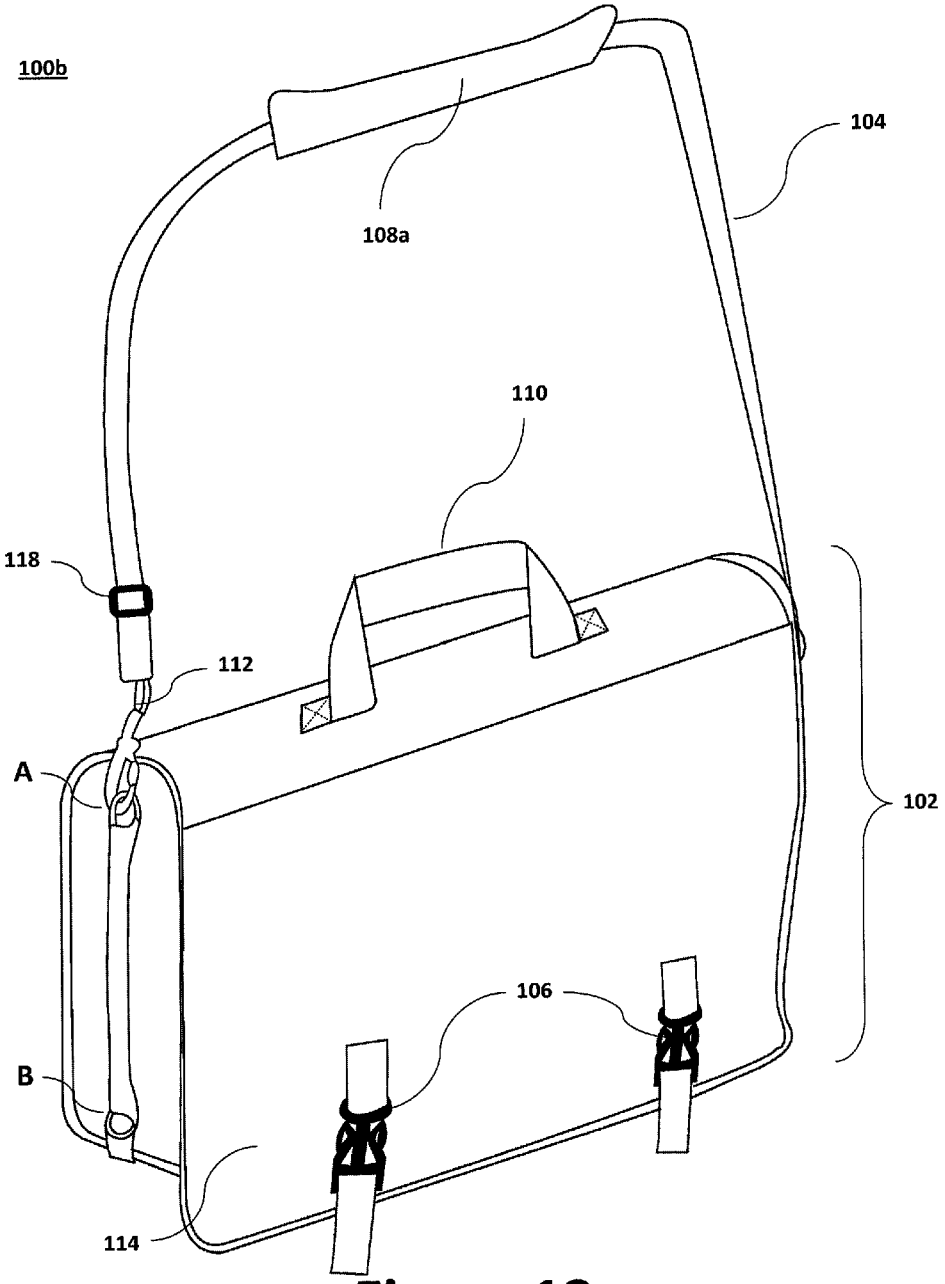
FIG. 12 is a front perspective view of an example combination bag according to a second aspect in an over-the-shoulder configuration.
Figure 13:
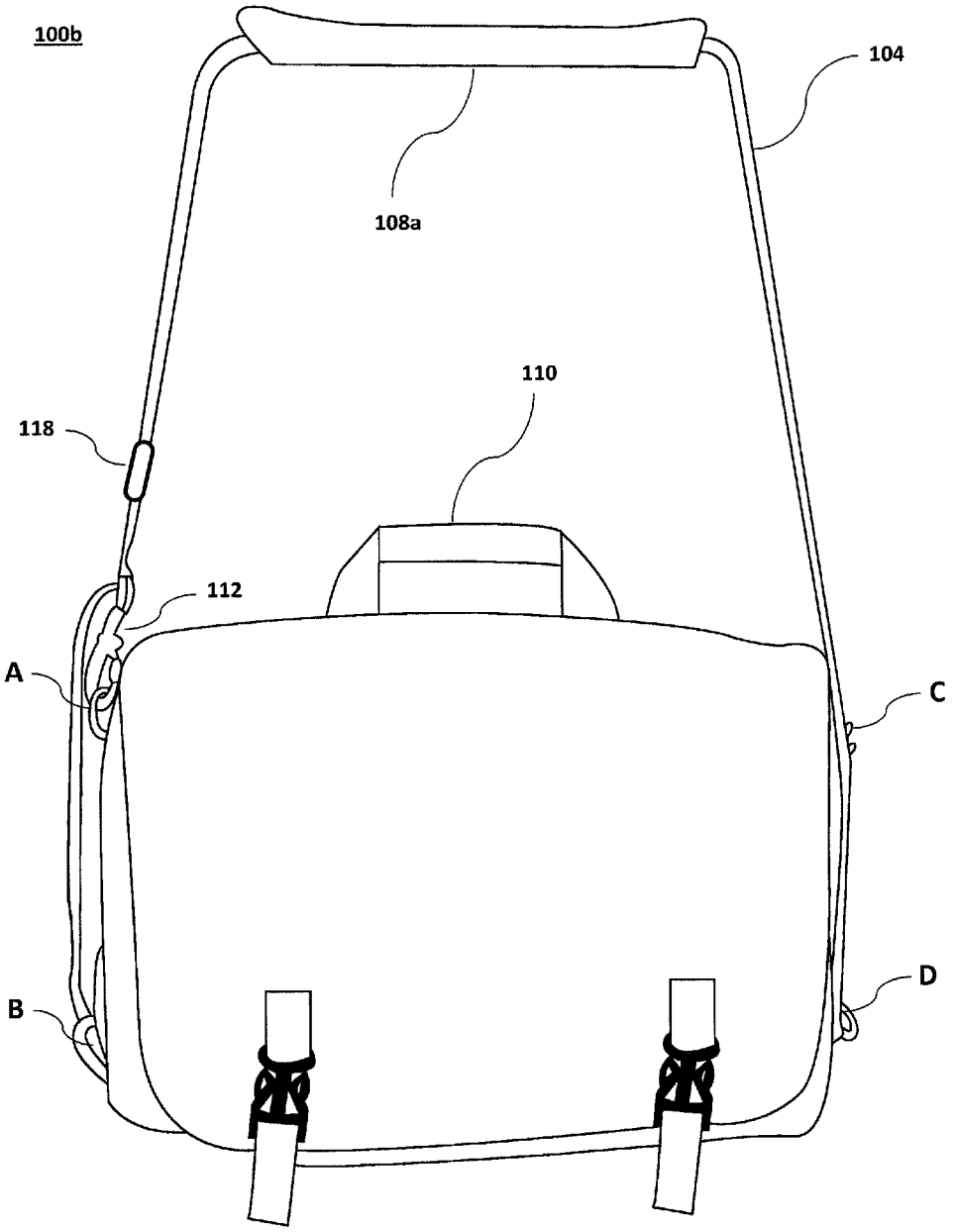
FIG. 13 is a front view of the combination bag of FIG. 12 in the over-the-shoulder configuration.

FIG. 12 illustrates a front perspective view of a combination bag 100*b* according to a second aspect of the present invention. FIGS. 12 and 13 illustrate the combination bag 100*b* in an over-the-shoulder configuration. Just like the combination bag 100*a* of FIGS. 1-11, the combination bag 100*b* generally comprises a bag body 102 and a strap 104. However, the combination bag 100*b* may be constructed such that the strap 102 may be fixedly attached to the bag body 102 at only one connection point (e.g., connection point A). The conversion from over-the-shoulder to the backpack configuration functions in substantially the same manner as the combination bag 100*a* of FIGS. 1 through 11. However, according to this aspect, the strap 104 may be fixedly attached to the bag body 102 at only connection point A, while the remaining connection points B, C, and D are slideably coupled using, for example, a hoop, a loop, or a slit.

Figure 14:
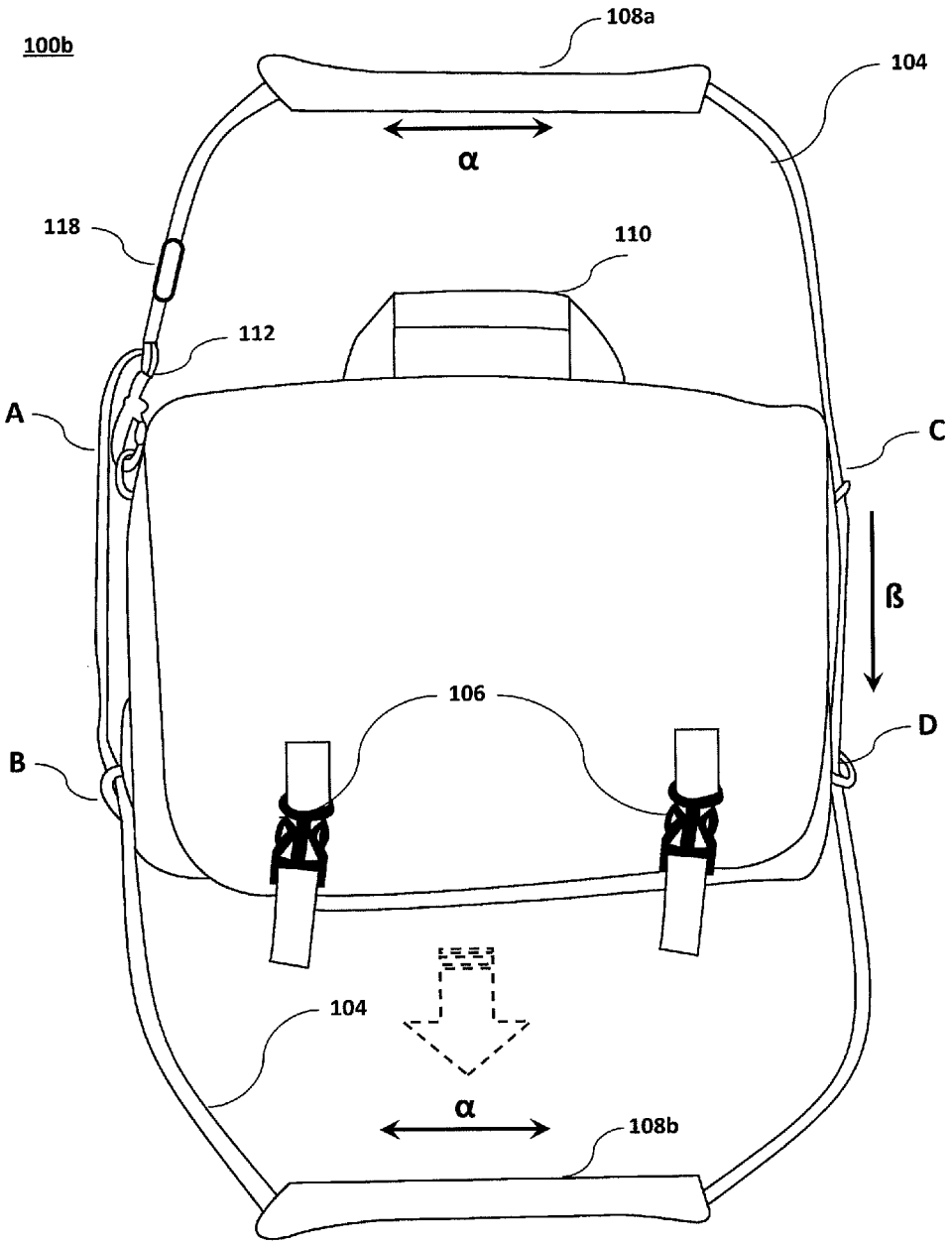
FIG. 14 is a front view of the combination bag of FIG. 12 during transition from the over-the-shoulder configuration to a backpack configuration.

As illustrated in FIG. 14, to transition from the over-the-shoulder configuration of FIG. 12 to the backpack configuration, the wearer need only tug the strap portion between connection points B & D (e.g., via a padded portion 108*b*), which may be positioned opposite the handle 110, thereby causing the strap 104 to travel through connection points C, D in direction 13. As the wearer pulls the strap portion positioned opposite the handle 110, the strap portions on each side of the bag body 102 (i.e., between connection points A & C and connection points B & D) form a rough loop between the contour of the strap 104 and the bag body 102, through which one of the wearer's arms may be stuck. The wearer may pull the strap until the strap portions on each side of the bag body 102 are approximately equal, thereby forming two shoulder straps. The two shoulder straps may be slung over the shoulders so that the weight of the backpack is distributed on the shoulders and the combination bag 100*b* can be carried on the back in a manner akin to that of a traditional, dual-strap backpack. As previously noted, the padded portions 108*a*, 108*b* may be slideably attached to the strap 104 so that they may be adjusted in direction α.

Figure 15:
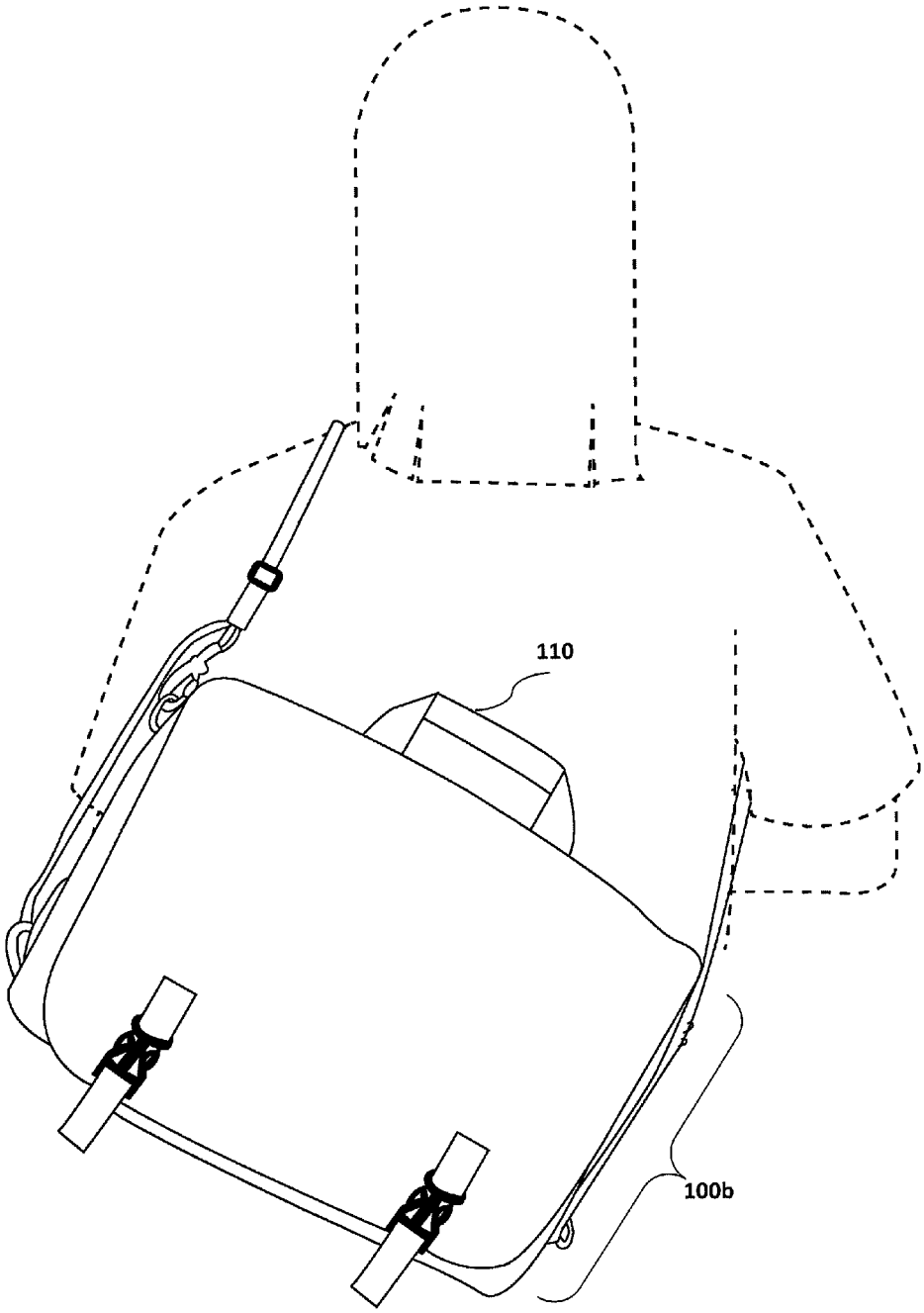
FIG. 15 is a view of a combination bag of FIG. 12 in the over-the-shoulder configuration while being used by a wearer.
Figure 16:
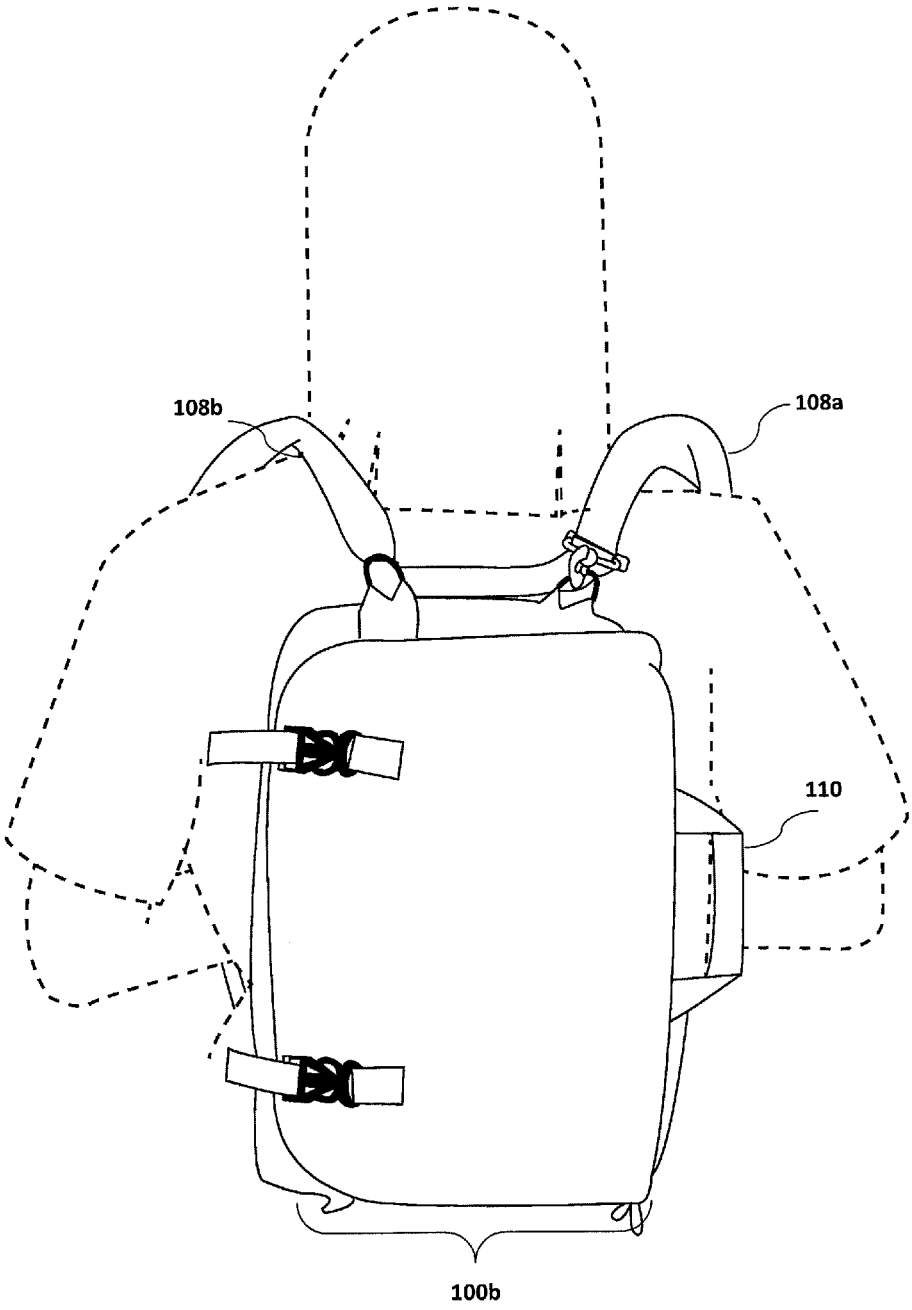
FIG. 16 is a view of a combination bag of FIG. 12 in the backpack configuration while being used by a wearer.

FIG. 15 provides a view of the combination bag 100*b* in the over-the-shoulder configuration while in use by a wearer, and FIG. 16 provides a view of the combination bag 100*b* in a backpack configuration while in use by a wearer.

Figure 17:
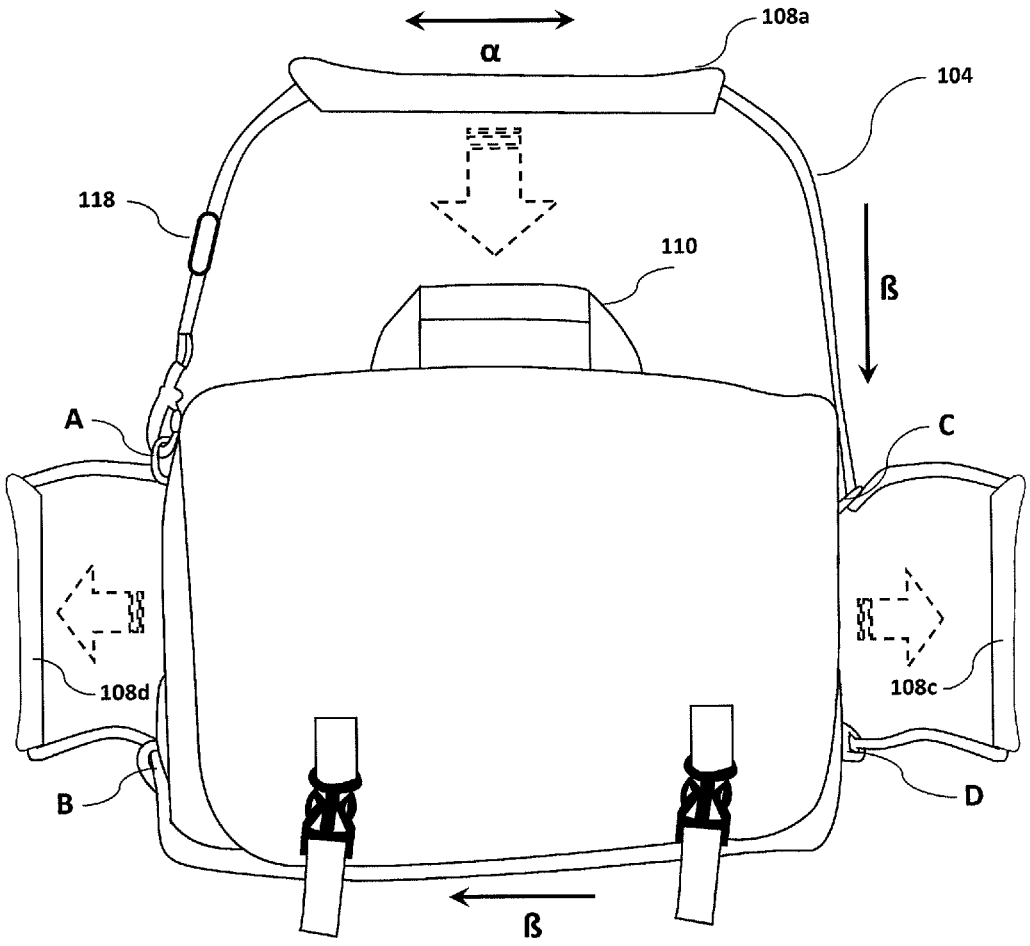
FIG. 17 is a front view of the combination bag during transition from an over-the-shoulder configuration to a backpack configuration according to another aspect.

As illustrated in FIGS. 11 and 16, once the combination bag 100*a*, 100*b* has transitioned from the over-the-shoulder to the backpack configuration, the bag body 102 has rotated 90 degrees. If the designer wishes to maintain the same orientation throughout transition, the strap portions on the sides (i.e., between connection points A & B and connection points C & D) may be pulled and used to form the arm holes as illustrated in FIG. 17. To increase comfort, padded portions 108*c*, 108*d* may be provided on each side for use the during backpack configuration. As with the bag of FIGS. 1-11, the padded portions may be slideably attached to the strap 104.

While the strap 104 may be fixedly attached at two connection points A, B as illustrated in FIGS. 1-11, fixedly attaching the strap 104 to the bag body 102 at a single connection point A as illustrated in FIGS. 12-16 is also possible. However, when the strap portions on the sides are used to achieve a backpack configuration, as discussed above and illustrated in FIG. 17, the strap may be fixedly attached at connection points B, D when two connection points are desired because fixedly attaching the strap 104 at both connection points A, B could prohibit the adjustment of the side strap. Similarly, fixedly attaching the strap 104 at connection points A, C could inhibit the adjustment of the top strap, thus potentially inhibiting over-the-shoulder use. Conversely, the strap 104 may be fixedly attached at any of the connection points when only a single fixedly attached connection point is desired (e.g., connection point A). Alternatively, the strap 104 may be slideably coupled at all the connection points when the strap 104 is connected at its distal ends and configured to substantially form a loop.

Although various embodiments have been described with reference to a particular arrangement of parts, features, and the like, these are not intended to exhaust all possible arrangements or features, and indeed many other embodiments, modifications, and variations will be ascertainable to those of skill in the art.

All U.S. and foreign patent documents, and all articles, brochures, and all other published documents discussed above are hereby incorporated by reference into the Detailed Description.

What is claimed is:

1. A combination bag, comprising:

a bag body having a front panel, a back panel, a bottom panel, a first side panel, a second side panel opposite the first side panel, and an opening opposite the bottom panel;

a plurality of connection points positioned on the bag body, each of said plurality of connection points having a securing mechanism; and a strap, wherein the strap comprises a first distal end, a second distal end, and at least one connector for attaching the strap to the bag body, wherein the first distal end and the second distal end are fixedly attached to the bag body at a first connection point, said first connection point being positioned on said first side panel, wherein a portion of the strap between said first distal end and said second distal end is slideably coupled to the bag body at a second connection point, a third connection point, and a fourth connection point, wherein the strap is configured to enable a wearer to alternate between (a) an over-the-shoulder configuration, and (b) a backpack configuration without disconnecting or reconnecting the strap, wherein, when in the over-the-shoulder configuration, (1) at least a portion of the strap between said third connection point and said forth connection point is adjacent to said second side panel, and (2) at least a portion of the strap between said second connection point and said third connection point is adjacent to said bottom panel, and wherein, when in the backpack configuration, (1) at least a portion of the strap between said third connection point and said fourth connection point is adjacent to said second side panel, (2) at least a portion of the strap between said first connection point and said fourth connection point traverses said pack panel, and (3) at least a portion of the strap between said second connection point and said third connection point traverses said back panel.

2. The combination bag of claim 1, wherein a portion of the strap between said first connection point and said fourth connection point defines a single rough loop while in the over-the-shoulder configuration.

3. The combination bag of claim 1, wherein (a) said at least a portion of the strap between said first connection point and said fourth connection point defines a first rough loop, and (b) said at least a portion of the strap between said second connection point and said third connection point defines a second rough loop while in the backpack configuration.

4. The combination bag of claim 1, wherein the strap is:

fixedly attached to the bag body at the first connection point by connecting a first connector positioned at the first distal end of the strap to a first securing mechanism positioned at the first connection point, fixedly attached to the bag body at the second connection point by connecting a second connector positioned at the second distal end of the strap to a second securing mechanism positioned at the second connection point; and slideably coupled with the bag body at the third connection point and the fourth connection point, wherein said portion of the strap between said first distal end and said second distal end passes through a third securing mechanism positioned at said third connection point and a fourth securing mechanism positioned at said fourth connection point.

5. The combination bag of claim 4, wherein at least one of the first securing mechanism, the second securing mechanism, the third securing mechanism and, the fourth securing mechanism is a hoop, a ring, a carabiner, or a loop.

6. The combination bag of claim 1, wherein the strap is adjustable in length.

7. The combination bag of claim 1, wherein the strap comprises one or more slideably attached padded portions.

8. The combination bag of claim 1, wherein the bag body and the strap are constructed from a material chosen from the group consisting of: leather, polymers, fabric, and combinations thereof.

9. A combination bag, comprising:

a bag body having a front panel, a back panel, a bottom panel, a first side panel, a second side panel opposite the first side panel, and an opening opposite the bottom panel;

a plurality of connection points positioned on the bag body, each of said plurality of connection points having a securing mechanism; and a strap, wherein the strap comprises a first distal end, a second distal end, and at least one connector for attaching the strap to the bag body, wherein the first distal end and the second distal end are fixedly attached to the bag body at a first connection point, said first connection point being positioned on said first side panel, wherein a portion of the strap between said first distal end and said second distal end is slideably coupled to the bag body at a second connection point, a third connection point, and a fourth connection point, wherein (a) said second connection point is positioned on said first side panel, and (b) said third connection point and said fourth connection point are positioned on said second side panel, wherein the strap is configured to enable a wearer to alternate between (a) an over-the-shoulder configuration and (b) a backpack configuration without disconnecting or reconnecting the strap, wherein, when in the over-the-shoulder configuration, (1) at least a portion of the strap between said third connection point and said forth connection point is adjacent to said second side panel, and (2) at least a portion of the strap between said second connection point and said third connection point is adjacent to said bottom panel, and wherein, when in the backpack configuration, (1) at least a portion of the strap between said third connection point and said fourth connection point is adjacent to said second side panel, (2) at least a portion of the strap between said first connection point and said fourth connection point traverses said pack panel, and (3) at least a portion of the strap between said second connection point and said third connection point traverses said back panel.

10. The combination bag of claim 9, wherein a portion of the strap between said first connection point and said fourth connection point defines a single rough loop while in the over-the-shoulder configuration.

11. The combination bag of claim 9, wherein (a) said at least a portion of the strap between said first connection point and said fourth connection point defines a first rough loop, and (b) said at least a portion of the strap between said second connection point and said third connection point defines a second rough loop while in the backpack configuration.

12. The combination bag of claim 9, wherein the strap is:

Fixedly attached to the bag body at the first connection point by connecting a first connector positioned at the first distal end of the strap and a second connector positioned at the second distal end of the strap to a first securing mechanism positioned at the first connection point; and slideably coupled with the bag body at the second connection point, the third connection point, and the fourth connection, wherein said portion of the strap between said first distal end and said second distal end passes through (1) a second securing mechanism positioned at said second connection point, (2) a third securing mechanism positioned at said third connection point, and (3) a fourth securing mechanism positioned at said fourth connection point.

13. The combination bag of claim 12, wherein at least one of the first securing mechanism, the second securing mechanism, the third securing mechanism, and the fourth securing mechanism is a hoop, a ring, a carabiner, or a loop.

14. The combination bag of claim 9, wherein the strap is adjustable in length.

15. The combination bag of claim 9, wherein the strap comprises one or more slideably attached padded portions.

16. The combination bag of claim 9, wherein the bag body and the strap are constructed from a material chosen from the group consisting of: leather, polymers, fabric, and combinations thereof.

17. A combination bag, comprising:

a bag body having a front panel, a back panel, a bottom panel, a first side panel, a second side panel opposite the first side panel, and an opening opposite the bottom panel;

four hoops, wherein a first hoop and a second hoop are positioned on the first side panel, and a third hoop and a fourth hoop are positioned on the second side panel; and a strap having a first end, a second end, and a strap portion therebetween, wherein (a) a first connector is positioned at said first end and configured to couple with said first hoop, and (b) a second connector is positioned at said second end and configured to couple with said second hoop, wherein said strap portion passes through said third hoop and said fourth hoop, whereby the strap is configured to enable a wearer to alternate between (a) an over-the-shoulder configuration and (b) a backpack configuration without disconnecting or reconnecting the strap, wherein, when in the over-the-shoulder configuration, (1) at least a portion of the strap between said third connection point and said forth connection point is adjacent to said second side panel, and (2) at least a portion of the strap between said second connection point and said third connection point is adjacent to said bottom panel, and wherein, when in the backpack configuration, (1) at least a portion of the strap between said third connection point and said fourth connection point is adjacent to said second side panel, (2) at least a portion of the strap between said first connection point and said fourth connection point traverses said pack panel, and (3) at least a portion of the strap between said second connection point and said third connection point traverses said back panel.

18. The combination bag of claim 17, wherein (1) a portion of the strap between said first connection point and said fourth connection point defines a single rough loop while in the over-the shoulder configuration, and wherein (2) said at least a portion of the strap between said first connection portion and said fourth connection portion defines a first rough loop, and said at least a portion of the strap between said second connection portion and said third connection portion defines a second rough loop, while in the backpack configuration.

19. The combination bag of claim 17, wherein the strap is adjustable in length and comprises one or more slideably attached padded portions.

20. The combination bag of claim 17, wherein the bag body and the strap are constructed from a material chosen from the group consisting of: leather, polymers, fabric, and combinations thereof.

21. A combination bag, comprising:

a bag body having a front panel, a back panel, a bottom panel, a first side panel, a second side panel opposite the first side panel, and an opening opposite the bottom panel;

a plurality of connection points positioned on the bag body, each of said plurality of connection points having a securing mechanism, wherein a first connection point and a second connection point are positioned on said first side panel, and wherein a third connection point and a fourth connection point are positioned on said second side panel; and a strap, having a first end and a second end, wherein the first end is coupled to the second end to form a loop, wherein the strap is slideably coupled to the bag body at each of said first connection point, said second connection point, said third connection point, and said fourth connection point, and wherein the strap is configured to enable a wearer to alternate between (a) an over-the-shoulder configuration and (b) a backpack configuration without disconnecting or reconnecting the strap, wherein, when in the over-the-shoulder configuration, (1) at least a portion of the strap between said third connection point and said forth connection point is adjacent to said second side panel, and (2) at least a portion of the strap between said second connection point and said third connection point is adjacent to said bottom panel, and wherein, when in the backpack configuration, (1) at least a portion of the strap between said third connection point and said fourth connection point is adjacent to said second side panel, (2) at least a portion of the strap between said first connection point and said fourth connection point traverses said pack panel, and (3) at least a portion of the strap between said second connection point and said third connection point traverses said back panel.

* * * * *